US006513232B2

(12) United States Patent
Maggiolo

(10) Patent No.: US 6,513,232 B2
(45) Date of Patent: Feb. 4, 2003

(54) VERTICAL PIPE EXPANDER

(75) Inventor: Vinicio Maggiolo, Montagnana (IT)

(73) Assignee: C.M.S. Costruzione Macchine Speciali S.r.l., Alonte (IT)

( * ) Notice: Subject to any disclaimer, the term of this patent is extended or adjusted under 35 U.S.C. 154(b) by 0 days.

(21) Appl. No.: 09/996,989

(22) Filed: Nov. 30, 2001

(65) Prior Publication Data

US 2002/0069515 A1 Jun. 13, 2002

(30) Foreign Application Priority Data

Dec. 7, 2000 (IT) ..... PD00A0272

(51) Int. Cl.[7] ..... B23P 15/26

(52) U.S. Cl. ..... 29/727; 29/890.044; 29/523

(58) Field of Search ..... 29/727, 726, 818, 29/723, 890.044, 890.046, 890.053, 809, 523, 715, 890.047; 72/370.06, 370.07, 479; 269/43

(56) References Cited

U.S. PATENT DOCUMENTS 4,584,765 A * 4/1986 Gray
4,835,828 A * 6/1989 York et al.
4,980,966 A * 1/1991 Milliman et al.
5,097,590 A * 3/1992 Tokura
5,210,932 A * 5/1993 Tokura
5,220,722 A * 6/1993 Milliman
5,353,496 A * 10/1994 Harman et al.
5,685,066 A * 11/1997 Mohrmann et al.
6,163,955 A * 12/2000 Tsai
6,176,006 B1 * 1/2001 Milliman et al.

* cited by examiner

*Primary Examiner*—Gregory M. Vidovich
*Assistant Examiner*—T. Nguyen
(74) *Attorney, Agent, or Firm*—Guido Modiano; Albert Josif; Daniel J. O'Byrne

(57) ABSTRACT

A vertical pipe expander to be used to expand the pipes assembled with fins of finned heat exchangers comprises, on a supporting frame, supports for rods of pipe expanding cones, performing vertical translational motion and arranged above a seat for a heat exchanger to be subjected to pipe expansion. At least one cone supporting rod magazine is further provided that is arranged vertically with the cones directed downward, for arrangement, during machine setup, at the seat, the supports for the rods being constituted by a rod engaging and supporting device. The rod engagement and support device is associated with a device for selecting the rods of the magazine to be engaged or released.

13 Claims, 6 Drawing Sheets

VERTICAL PIPE EXPANDER

BACKGROUND OF THE INVENTION

The present invention relates to a vertical pipe expander.

Machines of this type are used to expand pipes assembled with the fins of finned heat exchangers.

Heat exchangers, after the initial assembly step in which individual fins are fitted on pipes so as to form a finned pack, require this additional technological operation in order to obtain stable contact between the fins and the very pipes.

This contact allows optimum heat transmission between the fluid that flows inside the pipes, and the fluid, normally air, that strikes the fins.

A vertical pipe expander is conceptually a hydraulic press with various electromechanical servomechanisms, in which a finned heat exchanger is arranged vertically in a downward region on a supporting frame.

In the region above the supporting frame there are rods provided at their tips with pipe expanding cones; such rods are associated with a corresponding support for vertical movement and are arranged vertically.

The rods that support the pipe expanding cones are actuated simultaneously so as to advance downward, entering the pipes of the heat exchanger so as to widen their diameter by means of the cones.

However, pipe expanders of the known type are not free from drawbacks.

They are in fact particularly inflexible from the point of view of operation.

Heat exchangers can be manufactured with pipes having different thicknesses and diameters.

This entails the use of cones that are specific for each pipe thickness, therefore entailing the need to replace the rods when the type of exchanger varies.

Furthermore, since the arrangement of the pipes varies for each exchanger type, it is necessary to provide a device for selecting the cone supporting rods that must perform the expansion whenever it is necessary to an exchanger whose configuration is different from that of a preceding one.

The rod replacement operation is currently completely manual; furthermore, since the cones have size differences that are difficult to distinguish with the naked eye, the machine can often be subjected to an incorrect setting.

Machine downtimes are therefore particularly high, since the setting operation also is completely manual.

SUMMARY OF THE INVENTION

The aim of the present invention is to solve or substantially reduce the problems of known types of vertical pipe expander.

Within this aim, an important object is to provide a pipe expander that is operatively flexible and versatile.

Another object is to provide a machine in which cone supporting rods of different sizes can be changed completely automatically.

Another object is to provide a pipe expander with automatic selection of the rods to be used in the technological operation.

Another object is to provide a pipe expander that requires very short machine downtimes and setup times.

Another object is to provide a machine that is safe for the user and ergonomic.

This aim and these and other objects that will become better apparent hereinafter are achieved by a pipe expander of the vertically elongated type that comprises, on a supporting frame, supporting means for rods that support pipe expanding cones, which can perform a vertical translational motion and are arranged above a seat for a heat exchanger to be subjected to pipe expansion, characterized in that it comprises at least one cone supporting rod magazine that is arranged vertically so that the cones are directed downwardly, to be arranged, during a machine setup step, at said seat, said supporting means for cone supporting rods being constituted by a device for engaging and supporting rods at their rear end portion, said rod engagement and support device being associated with a device for selecting the rods of the magazine to be engaged or released, with said magazine arranged in said seat.

BRIEF DESCRIPTION OF THE DRAWINGS

Further characteristics and advantages of the invention will become better apparent from the description of a preferred but not exclusive embodiment thereof, illustrated only by way of non-limitative example in the accompanying drawings, wherein.

DESCRIPTION OF THE PREFERRED EMBODIMENTS

Figure 1:
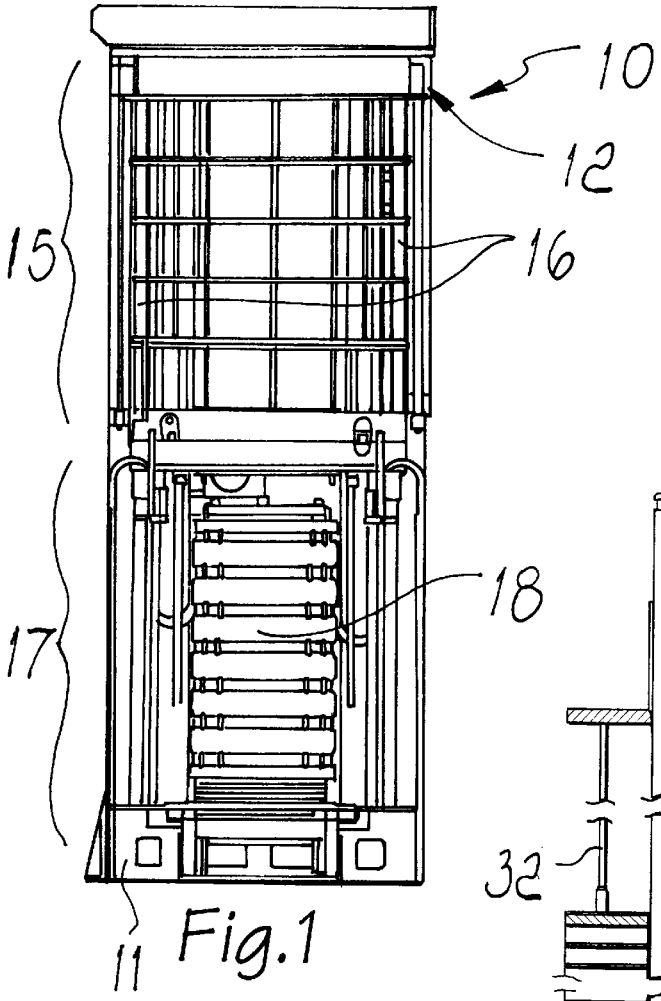
FIG. 1 is a front view of a pipe expander according to the invention.
Figure 2:
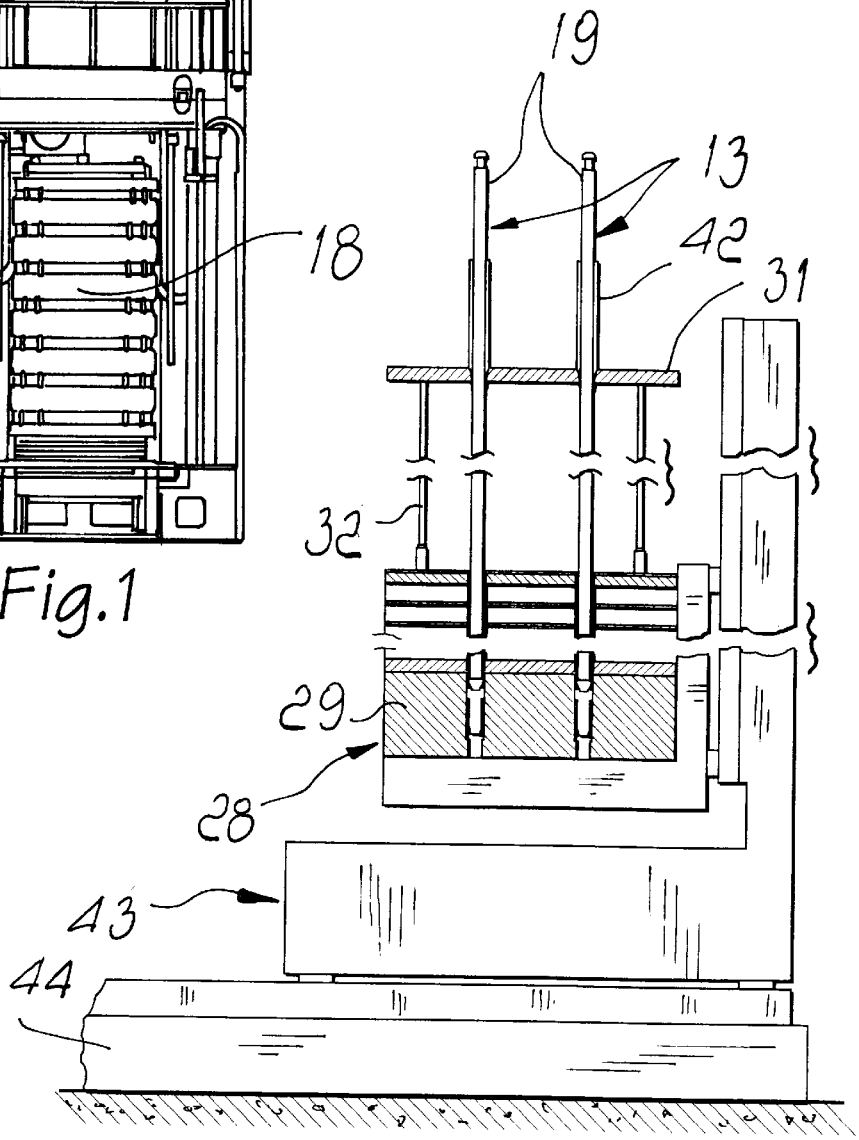
FIG. 2 is a partially sectional schematic side view of a portion of the pipe expander of the preceding figure.

With reference to the figures, a pipe expander according to the invention is generally designated by the reference numeral 10.

The pipe expander 10 is of the vertically elongated type and comprises, on a lattice-like frame 11 that comprises a footing 44, supporting means 12 for rods 13 provided, at their front end, with cones 14 for expanding the pipes of a heat exchanger.

In FIGS. 2 to 7, the pipe expander 10 has been illustrated schematically, for the sake of simplicity, as if it had just two rods 13.

The supporting means 12 is arranged on the frame 11 at its upper portion 15.

At the upper portion 15, the supporting means 12 performs a vertical translational motion on corresponding rectilinear guides 16 that are not shown in FIGS. 2 to 7 for the sake of simplicity.

The lower portion 17 of the frame 11 forms a seat 18 for a heat exchanger, arranged in axial alignment with the rods 13 associated with the supporting means 12, to be subjected to the technological expansion process.

The supporting means 12 is constituted by a device for engaging and supporting the rear end portion 19 of the rods 13, which is described in greater detail hereinafter.

The engagement and support device comprises a substantially plate-like slider 20 that is arranged horizontally and so that it can slide with a transverse rectilinear motion on the lower portion 21*a* of a supporting plate 21, which in turn can perform a vertical translational motion because it is associated with the rectilinear guides 16.

The slider 20 is provided with a plurality of slotted holes 22 that are aligned in the direction of the translational motion and are equal in number to the rods 13 to be supported.

Each slotted hole 22 is constituted by two portions: a first portion 23, whose transverse dimension is greater than the diameter of the rods 13, and a second portion 24, whose transverse dimension is smaller than the diameter of the rods 13 and greater than the diameter of a circumferential groove 25 provided in the rear end portion 19 of each rod 13.

The groove 25 has an axial dimension that is greater than the thickness of the slider 20, so that the second portion 24 of the hole 22 can engage thereon.

The supporting plate 21 is provided with holes 26 that correspond to the rods 13 and allow said rods to enter and pass through the slider 20 and through the slotted holes 22.

Multiple guiding plates 27 for the rods 13 associated with said supporting means 12 and provided with through holes 45 for said rods 13 are arranged below the supporting plate 21 so that they can slide on the rectilinear guides 16.

Said guiding plates 27 and the supporting plate 21 are arranged so as to be spaced when inactive.

In practice, the supporting means 12, as described in greater detail hereinafter, picks up the rods 13 from a magazine 28.

The magazine 28 comprises a box-like body 29 that is provided with tubular seats 30 for rods 13 arranged vertically, with cones 14 arranged downwardly and with at least the rear end portion 19 arranged externally.

The magazine 28 further comprises a perforated guiding plate 31 for the rear end portions 19 of the rods 13 arranged outside the box-like body 29.

The perforated plate 31 can perform a vertical translational motion and is associated with pneumatic cylinders 32 that act as elastic spring means that push upward.

In particular, the perforated guiding plate 31, when the pneumatic cylinders 32 are inactive, is arranged at a lower level than the grooves 25 of the rods 13.

The pipe expander 10 further comprises a device for selecting the rods 13 to be engaged by means of the slider 20, which is described in greater detail hereinafter.

The device for selecting the rods 13 to be engaged is constituted by a plurality of pushers 33, one for each rod 13, which are arranged above the slider 20 in corresponding seats 34 provided in the upper portion 21*b* of the supporting plate 21.

The pushers 33 are pneumatic cylinders, whose stems 35 are arranged coaxially to the holes 26 of the supporting plate 21.

Said stems 35 pass through the slotted holes 22 of the slider 20 without interfering with it even during its transverse translational motion.

The stems 35 then pass through the slider 20 through the slotted holes 22, partially entering the holes 26 of the supporting plate 21.

Each pusher 33 acts in opposition to a corresponding elastic element 36 arranged on the bottom of the magazine 28 for supporting a corresponding rod 13.

The elastic elements 36 are constituted by pistons 37, on which the rods 13 rest with the cones 14; said pistons can slide on corresponding vertical guides 38 and are associated with springs 39 that act by pushing upward.

In practice, the pistons 37 form a supporting surface that locally yields elastically for each rod 13.

The supporting plate 21 further supports, on two mutually opposite sides, two mutually opposite hydraulic actuators 40 for the transverse translational motion of the slider 20.

The guiding plate 27*a* arranged further downward has a numerically controlled position and is designed to pre-measure the finned pack of an exchanger to be subjected to the technological process of expansion.

Said plate 27*a* detachably supports spacer elements 41 for said finned pack.

Said spacer elements 41 are constituted by tubular segments that are arranged coaxially to the rods 13 and are fixed at their front end, by means of elastic snap rings, to said pre-measuring plate 27*a*.

Advantageously, flaring cups 42 for the end portion of the pipes of a finned exchanger can be fitted on the rods 13.

The cups 42 are fitted on the rear end portion 19 of the rods 13 and rest in an upward region on the perforated plate 31 of the magazine 28.

The cups 42 can slide on the rods 13 and encounter a downward limit for vertical translational motion at the cones 14.

The cups 42 instead encounter an upper limit for vertical translational motion at a guiding plate 27*b* that is arranged above the guiding and pre-measuring plate 27*a*.

The magazine 28 is arranged on a carriage 43 that can perform a vertical and transverse translational motion and is in turn arranged at the seat 18.

The movable carriage 43 can slide on the footing 44 of the frame 11 and supports the magazine 28 during a machine setup step, entering the space occupied by the seat 18.

As regards operation, during the machine setup step a rod magazine 28 is arranged at the movable carriage 43.

Figure 3:
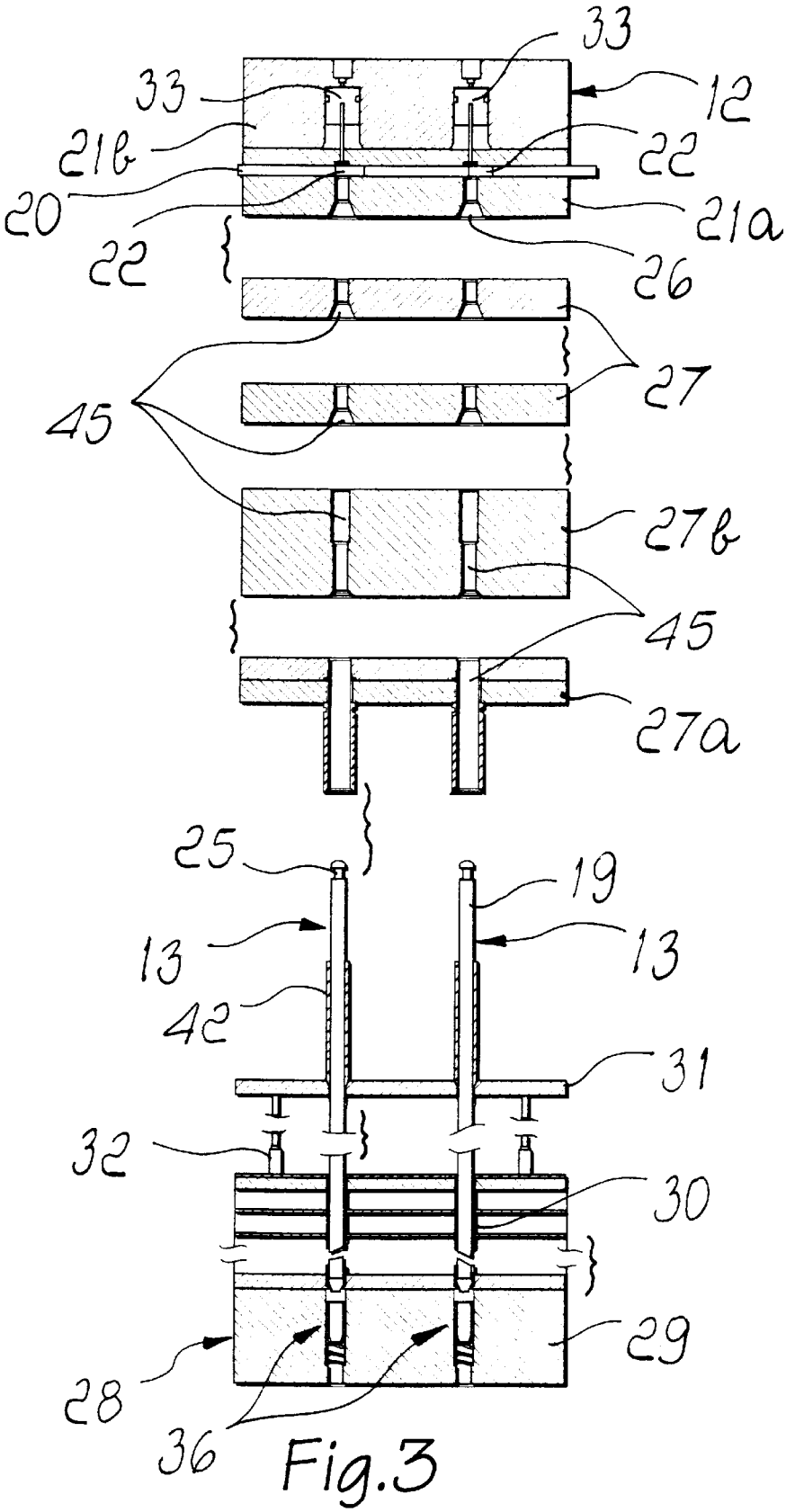
FIGS. 3, 4 and 5 are schematic front views of the pipe expander in three different steps of operation.

At this point the structure 10 is located at its upper stroke limit, as shown in FIG. 3, with the supporting plate 21 arranged at the maximum height and the guiding plates 27 in a spaced configuration.

The movable carriage 43 is actuated automatically so as to be arranged at the seat 18, so that the rods 13 contained in the magazine 28 are arranged coaxially to the holes of the guiding plates 27 and to the pushers 33 of the supporting plate 21.

At this point the vertical upward motion of the movable carriage 43 and the simultaneous downward motion of the supporting plate 21 are actuated.

As a consequence of the downward motion of the supporting plate 21, the guiding plates 27 also perform a downward transational motion, simultaneously reducing their relative distance.

In particular, the spacers 41 of the plate 27*b* rest on the perforated plate 31 of the magazine 28, pushing it downward in contrast with the pneumatic cylinders 32.

Figure 4:
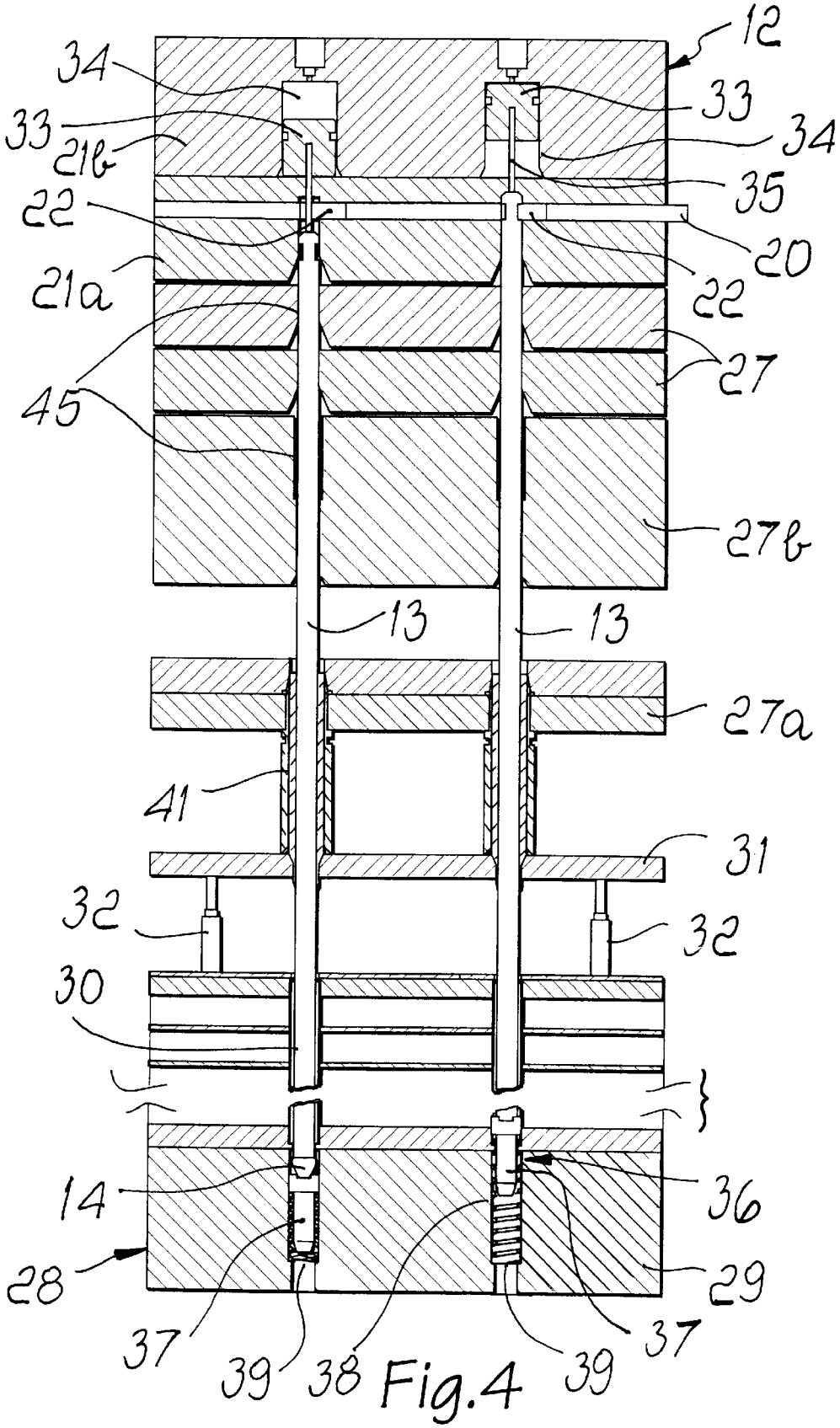
Figure 5:
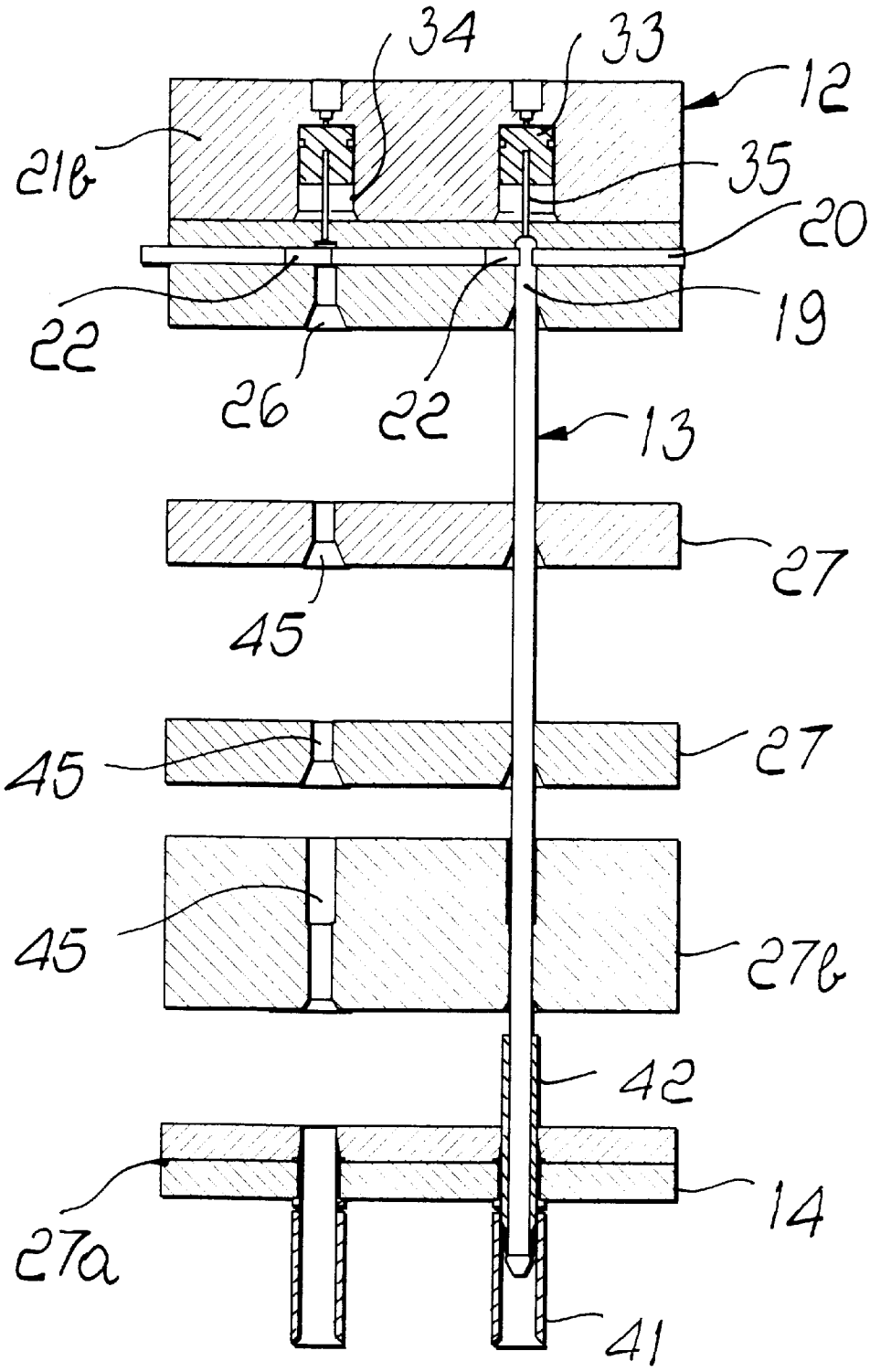
Figure 7:
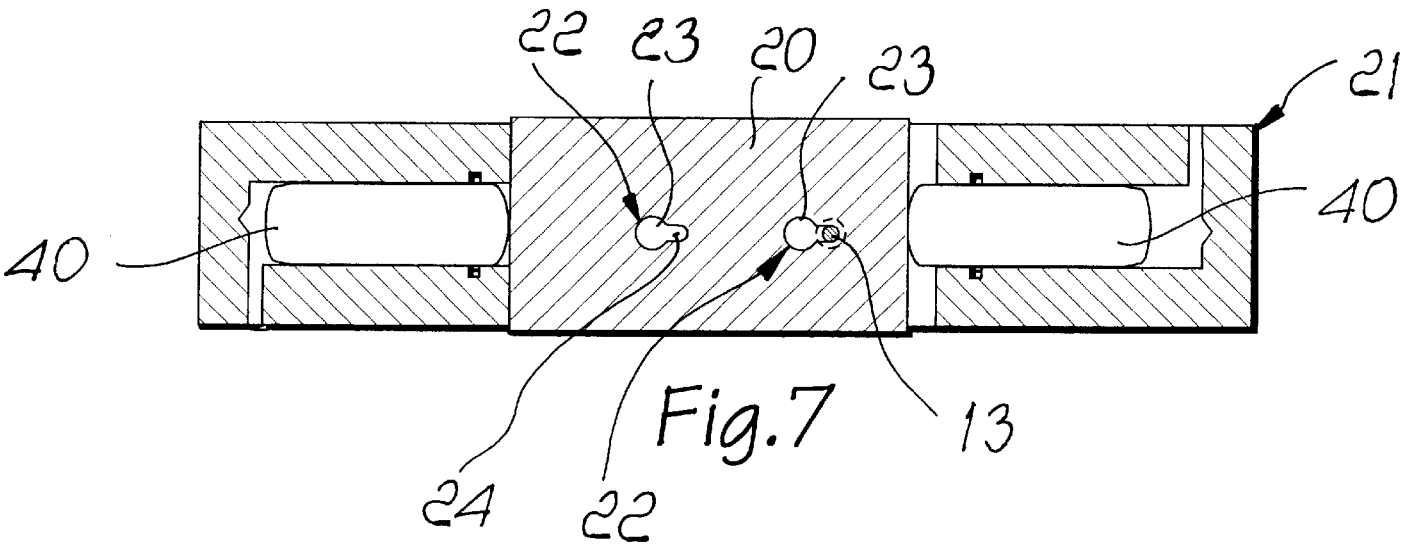
FIGS. 6 and 7 are schematic plan views of the pipe expander in two different steps of operation.
Figure 6:
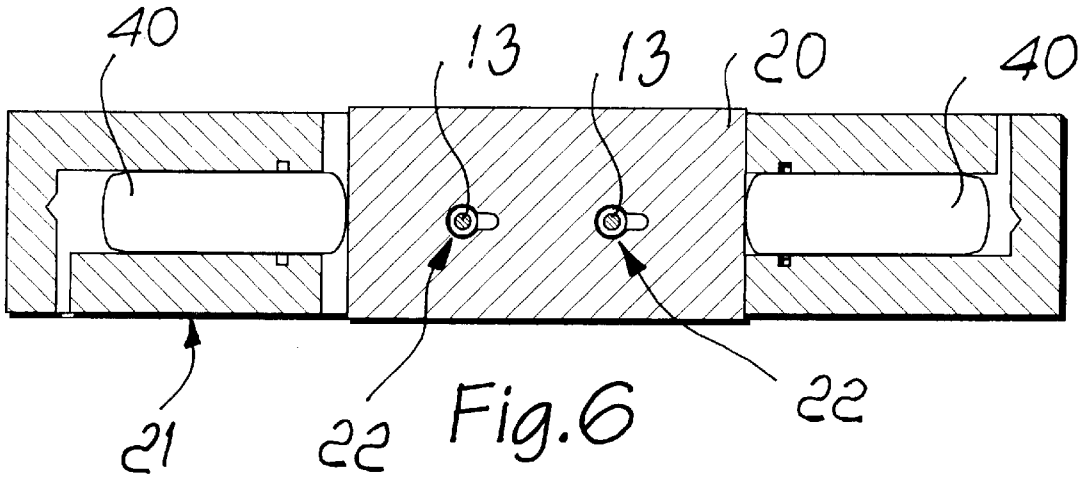

At the lower stroke limit of the structure 10, as shown in FIG. 4, the perforated plate 31 of the magazine 28 is pushed by the spacer elements 41 at its minimum height position and the guiding plates 27 are arranged closely together, with the supporting plate 21 also arranged at the minimum height.

In this configuration, the rods 13 pass through the spacers 41 and the holes of the guiding plate 27 and lie, with their rear end portion 19, inside the supporting plate 21.

In particular, the stems 35 of the pushers 33 pass through the slotted holes 22 of the slider 20, pushing the rods 13 beyond the space occupied by the slider 20 in contrast with the elastic elements 36 on which said rods 13 rest.

The slider 20 is arranged, in this case, so that the portions 23 of the slotted holes 22 are coaxial to the rods 13.

At this point, according to a preset program that depends on the type of heat exchanger to be processed subsequently, the selected pushers 33 are actuated, drawing them upward and allowing the elastic elements 36 to push the corresponding rods 13 upward, simultaneously allowing their rear end portion 19 to enter the space occupied by the slider 20 (see again FIG. 4).

At this point, the hydraulic actuators 40 actuate the translational motion of the slider 20 so that the portions 24 of the slotted holes 22 engage the grooves 25 of the rods 13 that pass through said slotted holes 22, engaging them stably.

Once this operation has ended, the expander 10 is actuated so as to be arranged again at its upper stroke limit.

The supporting plate 21 is drawn upward and the magazine 28, supported by the movable carriage 43, is returned downward and moved out of the space occupied by the seat 18.

In this manner, the rods 13 that have not been engaged remain inside the magazine 28, while the engaged ones are supported by the supporting plate 21.

At the upper stroke limit, the guiding plates 27 again arrange themselves so that they are spaced and the cones 14 of the rods 13 lie above the lower portion 17 of the supporting frame 11.

The machine is now set up and it is therefore possible to position a heat exchanger at the seat 18, aligned with the rods 13 supported by the plate 21.

The lowering of the supporting plate 21 is then actuated, accordingly allowing the cones 14 to engage in the pipes of the heat exchanger, increasing their diameter and stably ensuring their assembly with the fins.

If cups 42 are also arranged slidingly in the rods 13, when the rods 13 are almost at the end of their stroke, at the bottom stroke limit of the machine, the plate 27*b* pushes said cups 42 so as to flare the end portion of the pipes of the heat exchanger.

It is evident that the rods 13 are subjected to a rather intense tip stress (the machine can in fact generate up to 60 t in the press), which would entail inflection deformations.

The guiding plates 27 therefore have the function of keeping said rods 13 in a straight vertical configuration.

As mentioned, in FIGS. 2 to 7 the pipe expander 10 has been shown schematically as if it had only two rods 13.

Actually, the number of rods 13 is much higher.

Figure 8:
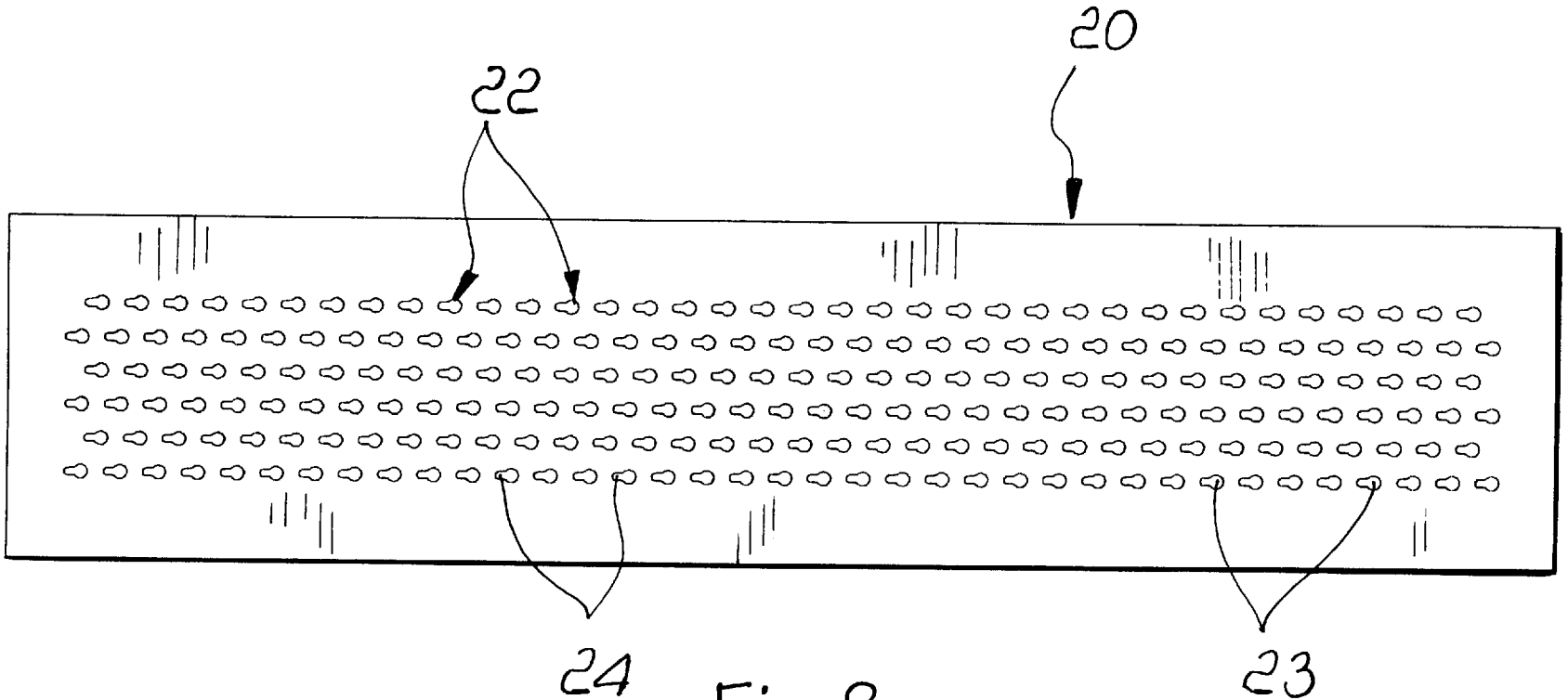
FIG. 8 is a plan view of a component of a pipe expander according to the invention.

FIG. 8, for example, is a plan view of a slider 20 that is normally used and is provided with a number of slotted holes 22 equal to the maximum number of rods 13 that can be supported by the plate 21.

The operation of the machine can be automated completely and is managed by a computerized system included in the control panel.

In practice, given the arrangement and number of pipes of a heat exchanger to be subjected to the technological process of expansion, a corresponding rod selection program is set up.

Moreover, the pipe expander can be provided with a plurality of interchangeable rod magazines provided with cones of different diameters, depending on the thickness of the pipes of the heat exchangers.

Furthermore, it can have a single machining station, of the fixed type or with an inverter or of the turntable type with two or more machining stations.

Therefore, depending on the size of the exchanger, and more specifically on the thickness, number and arrangement of the pipes, the pipe expander 10, given programs stored beforehand or entered during setup, is capable of using the rod magazine suitable for the pipe thickness and of selecting the number of rods to be taken from said magazine.

In practice it has been found that the present invention has achieved the intended aim and objects.

A pipe expander has in fact been provided by means of which the operation for replacing and selecting the rods for expanding the pipes of a heat exchanger has been automated completely.

Accordingly, there is a drastic reduction in machine downtimes and in setup times.

Moreover, the machine is more flexible and versatile.

The problem of accidental swapping of rods provided with cones of different sizes because they are difficult to recognize with the naked eye is solved.

Moreover, the pipe expander is remarkably safer, since operators are now located outside the footprint of the machine, which is controlled fully automatically.

The present invention is susceptible of numerous modifications and variations, all of which are within the scope of the appended claims.

All the technical details may be replaced with other technically equivalent elements.

The materials, so long as they are compatible with the contingent use, as well as the dimensions, may be any according to requirements.

The disclosures in Italian Patent Application No. PD2000A000272 from which this application claims priority are incorporated herein by reference.

What is claimed is:

1. A pipe expander of a vertically elongated type for expanding pipes of a heat exchanger, comprising: a supporting frame; cone supporting rods, supported at said frame; supporting means for rods; pipe expanding cones, supported at front end portions of said cone supporting rods to perform a vertical translational motion; a seat provided at said frame for accommodating a heat exchanger to be subjected to pipe expansion, said expanding cones being arranged above said seat; at least one cone supporting rod magazine arranged on a movable carriage; said magazine being arranged vertically with the expanding cones directed downwardly, so as to be arranged, during machine setup, at said seat, said supporting means for cone supporting rods being constituted by a device for engaging and supporting rods at a rear end portions of supporting rods and a selecting device associated with said device for engaging and supporting rods for automatically engaging or releasing selecting rods of the magazine, with said magazine arranged in said seat.

2. The pipe expander of claim 1, wherein each one of said rods has a circumferential groove formed in the rear end portion thereof, and wherein said device for engaging and supporting rods comprises a substantially plate-like slider that is arranged horizontally so as to perform translational motion in vertical and horizontal directions, said slider being provided with a plurality of slotted holes arranged in one of said horizontal directions of motion, in a number being at least equal to a number of rods of said magazine, each slotted hole comprising at least one first portion with a transverse dimension which is greater than a diameter of the rods and at least one second portion with a transverse dimension which is smaller than the diameter of the rods and greater than a diameter of a circumferential groove having an axial dimension that is greater than a thickness of said slider.

3. The pipe expander of claim 2, further comprising: a supporting plate provided with a seat formed thereon to correspond to said slider; and rectilinear guides arranged on said frame, said horizontal motion of said slider occurring on said corresponding seat formed in said supporting plate, and said vertical motion being provided by the translational motion of said supporting plate, which is slidable on said rectilinear guides, said supporting plate being further provided with access holes for access, within a space occupied by said slider, of the rear end portions of said rods.

4. The pipe expander of claim 3, wherein said device for engaging and supporting rods comprises a plurality of rod guiding plates that are spaced in an idle configuration, lie below said supporting plate, are slidable on said rectilinear guides, and are provided with through guiding holes for said rods, said through guiding holes being coaxial to said access holes of the supporting plate.

5. The pipe expander of claim 4, wherein said magazine comprises a box-like body that is provided with tubular seats for said rods, with said rods being arranged vertically with the pipe expanding cones arranged downward and with at least the rear end portions thereof arranged outside said box-like body.

6. The pipe expander of claim 5, characterized in that said rods have each a circumferential groove formed in the rear end portion thereof, said magazine comprising: a perforated plate that is actuatable to perform a vertical translational motion for guiding the rear end portions of the rods arranged outside said box-like body, and elastic means for pushing upward the perforated plate which is arranged, in an idle configuration, below said circumferential grooves.

7. The pipe expander of claim 6, wherein said elastic means are pneumatic cylinders.

8. The pipe expander of claim 2, comprising elastic means arranged on a bottom part of said magazine on which said rods rest, said selecting device being constituted by a plurality of pushers, one for each slotted hole of said slider, said pushers being arranged so as to act, during machine setup, on said rods in contrast with said elastic elements, said pushers retaining, on command, selected rods outside a space occupied by said slider.

9. The pipe expander of claim 8, wherein said pushers are constituted by pneumatic actuators arranged above said slider coaxially to the rods, said pneumatic actuators having stems acting by pushing on the rear end portion of said rods, said stems passing through the slotted holes of said slider and having such dimensions as to not interfere with the horizontal translational motion thereof.

10. The pipe expander of claim 8, further comprising: vertical guides and pushing springs, said elastic elements arranged on the bottom part of the magazine being constituted by pistons that are slidable on corresponding ones of said vertical guides and are associated with said pushing springs that act by pushing upward, each rod resting, with a cone thereof, on a corresponding one of said pistons, said pistons forming a supporting surface that locally yields elastically for each rod.

11. The pipe expander of claim 3, further comprising two hydraulic actuators supported laterally by said supporting plate, said hydraulic actuators being arranged mutually opposite for enabling movement of said rod engagement slider.

12. The pipe expander of claim 6, wherein a lower one of said rod guiding plates is arranged in a numerically controlled position and constitutes a pre-measurer for a finned pack of a heat exchanger to be subjected to pipe expansion.

13. The pipe expander of claim 12, comprising flaring cups for operating at end portions of pipes of a finned exchanger, said cups being fitted on said rods, above said perforated plate of said magazine, said cups being slidable on the rods, until encountering a lower stroke limiter constituted by the pipe expanding cones and an upper flared pusher stroke limiter, constituted by the guiding plate of the device for engaging and supporting rods that is arranged above said plate for pre-measuring a finned pack.

* * * * *